US010149547B2

(12) United States Patent
Wickett

(10) Patent No.: US 10,149,547 B2
(45) Date of Patent: Dec. 11, 2018

(54) SEAT RECLINE MECHANISM, ADJUSTABLE SEATING ASSEMBLY, AND METHOD

(71) Applicant: DavidHugh Limited, Cambridge (GB)

(72) Inventor: David Hugh Wickett, Cambridge (GB)

(73) Assignee: DavidHugh Limited, Cambridge (GB)

( * ) Notice: Subject to any disclaimer, the term of this patent is extended or adjusted under 35 U.S.C. 154(b) by 77 days.

(21) Appl. No.: 15/315,393

(22) PCT Filed: May 29, 2015

(86) PCT No.: PCT/GB2015/051573

§ 371 (c)(1),
(2) Date: Dec. 1, 2016

(87) PCT Pub. No.: WO2015/185894

PCT Pub. Date: Dec. 10, 2015

(65) Prior Publication Data

US 2017/0112289 A1 Apr. 27, 2017

(30) Foreign Application Priority Data

Jun. 2, 2014 (GB) ..... 1409784.4

(51) Int. Cl.
*A47C 7/58* (2006.01)
*A47C 1/02* (2006.01)
(Continued)

(52) U.S. Cl.
CPC ..... *A47C 7/58* (2013.01); *A47C 1/02* (2013.01); *A47C 1/031* (2013.01); *A47C 1/0342* (2013.01); *A47C 7/563* (2013.01); *A47C 7/60* (2013.01)

(58) Field of Classification Search
CPC .. A47C 7/58; A47C 7/563; A47C 7/60; A47C 7/56; A47C 1/031; A47C 1/032;
(Continued)

(56) References Cited

U.S. PATENT DOCUMENTS 1,802,318 A * 4/1931 Hanson ..... A47C 7/58 297/249
1,898,176 A * 2/1933 Gedris ..... A47C 7/58 248/240.4
(Continued)

FOREIGN PATENT DOCUMENTS

DE 19626585 1/1997
EP 0022039 1/1981
(Continued)

OTHER PUBLICATIONS

United Kingdom Search Report in counterpart GB application No. 1409784.4 dated Nov. 13, 2014.
(Continued)

*Primary Examiner* — Mark R Wendell
(74) *Attorney, Agent, or Firm* — Kirschstein, Israel, Schiffmiller & Pieroni, P.C.

(57) ABSTRACT

A seat recline mechanism for, and method of controlling motion of a first assembly relative to a second assembly within a seating assembly includes a mechanism having first and second bearings for attaching to the first assembly, and a hub for attaching to the second assembly. The hub includes first and second inclined surfaces, the second inclined surface being oppositely-facing relative to the first inclined surface. In use, the first bearing is arranged to act against the first inclined surface and the relative position of the first bearing with respect to the first inclined surface is adjustable; and the second bearing is arranged to act against the second inclined surface and the relative position of the second bearing with respect to the second inclined surface is adjustable. One or more such mechanisms are provided for the seating assembly.

25 Claims, 8 Drawing Sheets

(51) Int. Cl.

| | |
|---|---|
| ***A47C 1/034*** | (2006.01) |
| ***A47C 1/031*** | (2006.01) |
| ***A47C 7/56*** | (2006.01) |
| ***A47C 7/60*** | (2006.01) |

(58) Field of Classification Search
CPC . A47C 1/034; A47C 1/03205; A47C 1/03294; A47C 1/0342; A47C 1/035; A47C 1/0352; A47C 1/0347
USPC ..... 297/325, 326, 327, 313
See application file for complete search history.

(56) References Cited

U.S. PATENT DOCUMENTS

| | | | | | |
|---|---|---|---|---|---|
| 2,070,387 | A * | 2/1937 | Vandervoort | A47C 7/58 | 297/249 |
| 2,621,709 | A * | 12/1952 | Bell | A47C 7/58 | 297/249 |
| 3,014,686 | A * | 12/1961 | Stasinos | A47C 1/027 | 248/596 |
| 3,873,054 | A | 3/1975 | McKee | | |
| 4,790,599 | A | 12/1988 | Goldman | | |
| 5,590,930 | A * | 1/1997 | Glockl | A47C 3/0257 | 297/258.1 |
| 6,012,774 | A | 1/2000 | Potter | | |
| 6,056,363 | A * | 5/2000 | Maddox | A47C 3/0257 | 297/115 |
| 7,850,238 | B2 * | 12/2010 | Erb | A47C 1/024 | 297/321 |
| 2007/0001497 | A1 * | 1/2007 | Diffrient | A47C 1/03255 | 297/321 |
| 2009/0195040 | A1 * | 8/2009 | Birkbeck | A47C 1/03255 | 297/317 |
| 2015/0282621 | A1 * | 10/2015 | Miller | A47C 1/03255 | 297/188.01 |

FOREIGN PATENT DOCUMENTS

| | | |
|---|---|---|
| EP | 0918480 | 6/1999 |
| GB | 469313 | 7/1937 |
| GB | 1203695 | 9/1970 |
| GB | 2119639 | 11/1983 |
| WO | 8910080 | 11/1989 |

OTHER PUBLICATIONS

International Search Report in counterpart international application No. PCT/GB2015/051573 dated Sep. 17, 2015.

* cited by examiner

(PRIOR ART - from US 4,790,599, "Goldman")

(PRIOR ART - from US 4,790,599, "Goldman")

(PRIOR ART - from US 6,012,774, "Potter")

(with reference to US 6,012,774, "Potter")

(PRIOR ART - from EP 0 918 480 B1, "Samson")

SEAT RECLINE MECHANISM, ADJUSTABLE SEATING ASSEMBLY, AND METHOD

FIELD OF THE INVENTION

The present invention relates to a seat recline mechanism for adjusting the angle of inclination of a seat, to a seating assembly having such a mechanism, and to an associated method. The present invention is particularly applicable, but by no means limited, for use with a seat in which the angle between the back section and the seat section is fixed, such that, during adjustment (e.g. reclining), the back section and the seat section move as one.

BACKGROUND TO THE INVENTION

Adjustable mechanisms are commonly used in seating where active or passive control over the chair parameters is important. Applications include office chairs, airline seating, automotive seating, lounge chairs, chairs for back pain alleviation, specialist healthcare seating for frail elderly and disabled people, and wheelchairs. The ability to alter the orientation of a chair's supports gives control over posture, muscle activity and the distribution of load within the body. The distribution of load, particularly within the upper body, is an important factor in determining the extent to which spinal structures and innervated tissues are stressed and, in long-term sitting, this may affect comfort, discomfort and pain levels. The distribution of load at the body/support interface influences compressive forces acting on the skin and muscle and is, therefore, an important consideration in comfort where blood perfusion may be occluded. For those at risk this is an important component of pressure ulcer management. Muscle activity is also an important factor in sitting, where reducing static muscle activity to a minimum has long been a fundamental ergonomic principle. As with other biomechanical phenomena, muscle recruitment is affected by body orientation and load.

The ability to alter the orientation of a chair's supports is, therefore, an important aspect in seating design. The ease with which the alterations can be made is also very important. Ergonomists argue that there is no single optimum seating posture and that the aim should he for continuous movement where "the best posture is the next posture". This philosophy has had an important role in the development of office seating, but probably the best example of seating which achieves high comfort levels through ease of movement is the traditional rocking chair. So, there is a need for seating to do two things: to achieve biomechanically important postures and to control the ease of transition between them, whether passive or active.

A chair that aims to improve seating biomechanics has been disclosed in U.S. Pat. No. 4,790,599 (hereinafter referred to as "Goldman"). Conventional reclining chairs typically have a mechanism that recline the backrest with respect to the seat. Many also elevate or extend a leg rest either as a function of the backrest actuation or independently. In Goldman, the back section, seat section and leg rest section have a fixed structural relationship to each other (as shown in the present FIG. 1). The resulting reclinable seat structure swings inside a support structure (an outer base frame) via a seat recline mechanism; a pendulum arm connecting the seat to a swing pivot located at the approximate level of the armrests (as shown in the present FIG. 2). With this configuration and in the terminal recline position, an occupant has their feet raised above the heart level which is believed to be a more optimum position for achieving relaxation than those allowed by conventional reclining chairs.

A development from Goldman is disclosed in U.S. Pat. No. 6,012,774 (hereinafter is referred to as "Potter"), as shown in the present FIG. 3. The principal development concerns the types of design that can be used to construct the chair. In Potter it is argued that the pendulum arm connecting the seat to the swing pivot in Goldman constrains the types of design that can be realised because the pendulum arm cannot be obstructed. In Potter the seat recline mechanism involves a guide rail that is formed to follow a circumference that is defined by the pivot location in Goldman. In this way the pendulum arm is eliminated.

In both Goldman and Potter, whether physical or virtual, the seat recline mechanism has a single fixed centre rotation that defines the movement of the reclinable seat structure. This has limitations as described in European Patent No. 0 918 480 B1 (hereinafter referred to as "Samson"). In Samson it is argued that the problem with such an arrangement is the tendency of the reclinable seat structure, at least when occupied, to fall into either the upright or the fully reclined position (as shown in the present FIG. 4). This is because the combined centre of mass of the occupant and the reclinable seat structure is lower in these positions than the intermediate position requiring effort to move out of these terminal positions. In FIG. 4 this is illustrated by a circle centred on the virtual pivot point defined by the guide rail, the circumference of which passes through the centre of mass, and thus represents the motion path for the centre of mass. In Samson, the reclinable seat structure is suspended from the support structure by a pair of swing links that form the seat recline mechanism, as shown in the present FIG. 5. It is claimed that the geometry of the swing links suspending the reclinable seat structure is such that the combined centre of mass of the reclinable seat structure and any occupant remains at a substantially constant height during the movement of the chair.

A limitation in Samson is that the swing links constrain the types of design that can be used to construct the chair. This is because the swing links pivotally connect from the top of the support structure (just below the armrests) to a pendulum arm arising from the seat structure, all of which must be not be obstructed. To avoid risk of entrapment and meet the relevant safety standards, it is likely that at least the swing linkages must be concealed within a relatively large and immobile armrest, and this may inhibit ingress and egress from the side of the chair. This may be important as a fixed leg rest makes it difficult to ingress and egress from the front. Another limitation to Samson is that the use of swing linkages constrain the geometry of the seat recline mechanism. Samson will always follow two arcs defined by the swing linkages which may not be an optimal solution.

It can be seen from the prior art reported here that efforts have been made to improve the biomechanics of recline postures (Goldman), to improve the types of design that can be realised for these postures (Potter), and to improve the ease of transition between these postures (Samson). To advance beyond the prior art, there is a desire for a seat recline mechanism that delivers the same (or similar) seat recline postures with improved ease of transition, whilst allowing flexibility in respect of the types of design that can be realised.

SUMMARY OF THE INVENTION

According to a first aspect of the present invention there is provided a seat recline mechanism for controlling the motion of a first assembly relative to a second assembly within a seating assembly, the mechanism comprising: first and second bearing means for attaching to the first assembly; and a hub for attaching to the second assembly; wherein the hub includes first and second inclined surfaces, the second inclined surface being oppositely-facing relative to the first inclined surface; and wherein, in use, the first bearing means is arranged to act against the first inclined surface and the relative position of the first bearing means with respect to the first inclined surface is adjustable, and the second bearing means is arranged to act against the second inclined surface and the relative position of the second bearing means with respect to the second inclined surface is adjustable. For example, the first bearing means may move along the first inclined surface, and the second bearing means may move along the second inclined surface (or, alternatively, the bearing means may be fixed in position, and the surfaces of the hub may be movable relative to the bearing means). Since, in use, the first and second bearing means are both attached to the first assembly and are thereby coupled to one another at a fixed distance of separation, the movement of the first and second bearing means relative to the first and second surfaces of the hub gives rise to rotation of the first assembly relative to the second assembly. By virtue of the arrangement of the first and second inclined surfaces of the hub, and the manner with which the first and second bearing means can move relative to the first and second surfaces, such that said surfaces of the hub effectively function in a cam-like manner, the seat recline mechanism can be used to provide a range of recline postures with ease of transition between the postures.

In a presently-preferred embodiment the seat recline mechanism further comprises a third bearing means for attaching to the first assembly, the hub includes a third surface and, in use, the third bearing means is arranged to act against the third surface and the relative position of the third bearing means with respect to the third surface is moveable (i.e. during motion of the first assembly relative to the second assembly). By virtue of this third bearing means, all the bearing means can be retained on the hub, and thus the first assembly can be prevented from being detachable from the second assembly during use.

The third surface of the hub may be substantially at the bottom of the hub.

The third surface of the hub may incorporate stop means for limiting the extent of relative movement of the third bearing means with respect to the third surface, and thereby limit the overall amount by which the first assembly may be moved relative to the second assembly. In an embodiment, the third surface of the hub is shaped so as to incorporate the stop means.

In a presently-preferred embodiment the first and second surfaces of the hub are substantially linear, together forming an inverted "V" shape.

The first surface and/or the second surface of the hub may incorporate surface detailing such as grooves, recesses or bumps, for example to enable the first assembly to be reversibly held in one or more predetermined positions relative to the second assembly, and/or to give haptic feedback to the user (e.g. to indicate through vibrations when the end of the extent of possible movement is being approached).

In a presently-preferred embodiment the said surfaces are formed around the perimeter of the hub. However, in alternative embodiments the said surfaces may be formed inside the perimeter of the hub.

In a presently-preferred embodiment the hub is formed as a unitary structure (e.g. machined from steel, or some other suitable material).

However, in other embodiments the hub may comprise a plurality of hub components (e.g. discrete, spatially-separated components), such that one or more of said surfaces are provided by one hub component, and one or more others of said surfaces are provided by one or more other hub components.

According to a second aspect of the present invention there is provided a seating assembly comprising one or more seat recline mechanisms in accordance with the first aspect of the invention. In respect of the or each seat recline mechanism, the first bearing means is arranged to act against the first inclined surface and the relative position of the first bearing means with respect to the first inclined surface is adjustable, and the second bearing means is arranged to act against the second inclined surface and the relative position of the second bearing means with respect to the second inclined surface is adjustable.

In a presently-preferred embodiment the seating assembly comprises two of said seat recline mechanisms, one on each side of the seating assembly.

In a presently-preferred embodiment, in respect of the or each seat recline mechanism: the first assembly, to which the first and second bearing means are attached, is a reclinable seat structure; the second assembly, to which the hub is attached, is a support structure for the reclinable seat structure; and the reclinable seat structure is able to move relative to the support structure in a reclining manner by movement of said bearing means along said surfaces.

In an alternative embodiment, however, in respect of the or each seat recline mechanism: the second assembly, to which the hub is attached, is a reclinable seat structure; the first assembly, to which the first and second bearing means are attached, is a support structure for the reclinable seat structure; and the reclinable seat structure is able to move relative to the support structure in a reclining manner by rotation of the hub relative to the positions of said bearing means.

The seating assembly may further comprise means for reversibly securing the angle of the reclinable seat structure relative to the support structure, such as, for example, a direct locking device such as one or more spring pins, or a remote locking device such as a gas spring with a remotely-actuated release.

With regard to the constitution of the reclinable seat structure, in a presently-preferred embodiment this comprises a back section and a seat section, and optionally a leg rest section. The back section and seat section may be structurally fixed to one another, or may be adjustable relative to one another. Similarly, the leg rest section (if present) may be structurally fixed to the seat section, or may be at an adjustable angle.

With regard to the support structure, in a presently-preferred embodiment this is provided with a pedestal base and optionally swivel means too (e.g. a memory return spindle).

The seating assembly may further comprise one or more movable parts configured to move in dependence on the operation of the seat recline mechanism, the movable parts being, for example, one or more of a retractable leg rest, a reclining backrest (reclinable with respect to the seat), a headrest/backrest articulation, or a foldaway armrest.

According to a third aspect of the present invention there is provided a method of controlling the motion of a first assembly relative to a second assembly within a seating assembly, the method comprising: attaching first and second bearing means to the first assembly; and attaching a hub to the second assembly, wherein the hub includes first and second inclined surfaces, the second inclined surface being oppositely-facing relative to the first inclined surface; arranging the first bearing means to act against the first inclined surface of the hub; arranging the second bearing means to act against the second inclined surface of the hub; allowing the relative position of the first bearing means with respect to the first inclined surface of the hub to be adjusted; and allowing the relative position of the second bearing means with respect to the second inclined surface of the hub to be adjusted.

The hub may further include a third surface, and the method may further comprise: attaching a third bearing means to the first assembly; arranging the third bearing means to act against the third surface of the hub; and allowing the relative position of the third bearing means with respect to the third surface of the hub to change (i.e. during motion of the first assembly relative to the second assembly). Furthermore, the method may comprise limiting the extent of relative movement of the third bearing means with respect to the third surface.

The method may further comprise incorporating surface detailing such as grooves, recesses or bumps in the first surface and/or the second surface of the hub, so as to enable the first assembly to be held in one or more predetermined positions relative to the second assembly, and/or to give haptic feedback to the user.

In a presently-preferred embodiment, the first assembly is a reclinable seat structure, the second assembly is a support structure for the reclinable seat structure, and the method further comprises: moving the reclinable seat structure relative to the support structure in a reclining manner by movement of said bearing means along said surfaces.

However, in an alternative embodiment, the second assembly is a reclinable seat structure, the first assembly is a support structure for the reclinable seat structure, and the method further comprises: moving the reclinable seat structure relative to the support structure in a reclining manner by rotation of the hub relative to the positions of said bearing means.

The method may further comprise reversibly securing the angle of the reclinable seat structure relative to the support structure.

In presently-preferred embodiments of the above seat recline mechanism, seating assembly or method, the bearing means and hub are preferably configured to move relative to one another according to the geometry illustrated in FIG. 8 or FIG. 9.

BRIEF DESCRIPTION OF THE DRAWINGS

Embodiments of the invention will now be described, by way of example only, and with reference to the drawings in which.

DETAILED DESCRIPTION OF PREFERRED EMBODIMENTS

The present embodiments represent the best ways known to the Applicant of putting the invention into practice. However, they are not the only ways in which this can be achieved.

The present embodiments have been developed for adjustable chairs aimed at improved seating biomechanics and motion control whilst keeping the space required by the seat recline mechanism to a minimum. The preferred embodiments provide a seat recline mechanism comprising three roller bearings that translate around the perimeter of a central hub. The roller bearings may be fixed relative to the reclinable seat structure and the hub may be fixed relative to the support structure. The shape of the hub perimeter and its position with respect to the reclinable seat structure define the motion path of the chair and its balance.

The following chair design is given by way of example only and not of limitation. In this example the general configuration of the chair follows that disclosed by Goldman. Potter and Samson, such that the back section, seat section and leg rest section have a fixed structural relationship.

Figure 1:
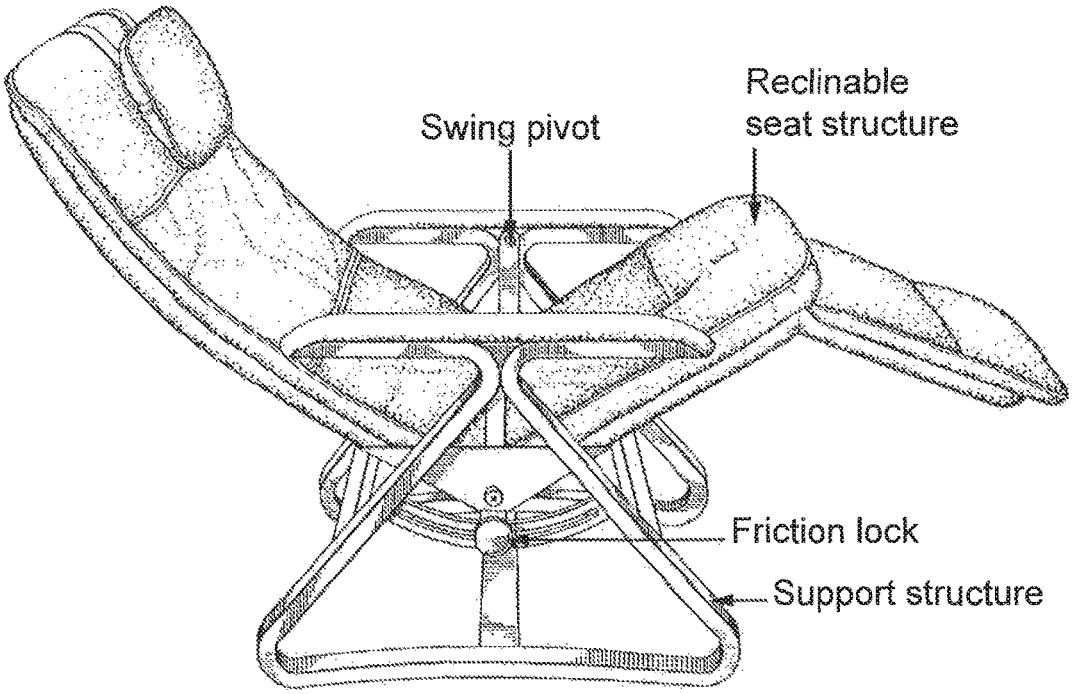
FIG. 1 shows the general configuration of a reclining chair disclosed in U.S. Pat. No. 4,790,599 ("Goldman")
Figure 2:
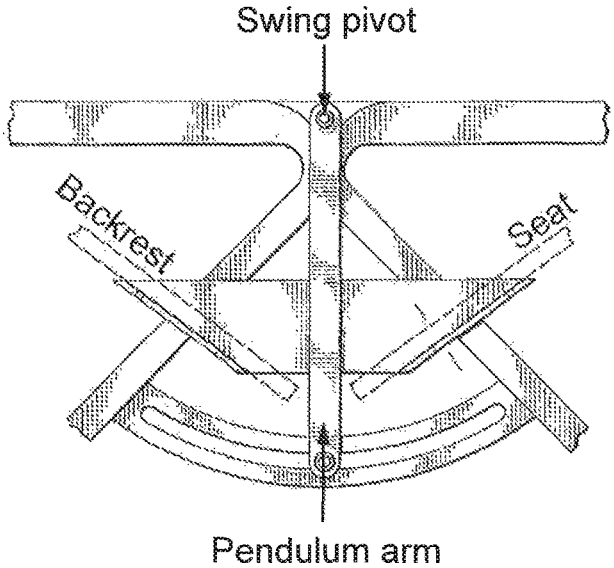
FIG. 2 shows the seat recline mechanism disclosed in U.S. Pat. No. 4,790,599 ("Goldman"), showing the pivot location for the reclinable seat structure and the pendulum arm.
Figure 3:
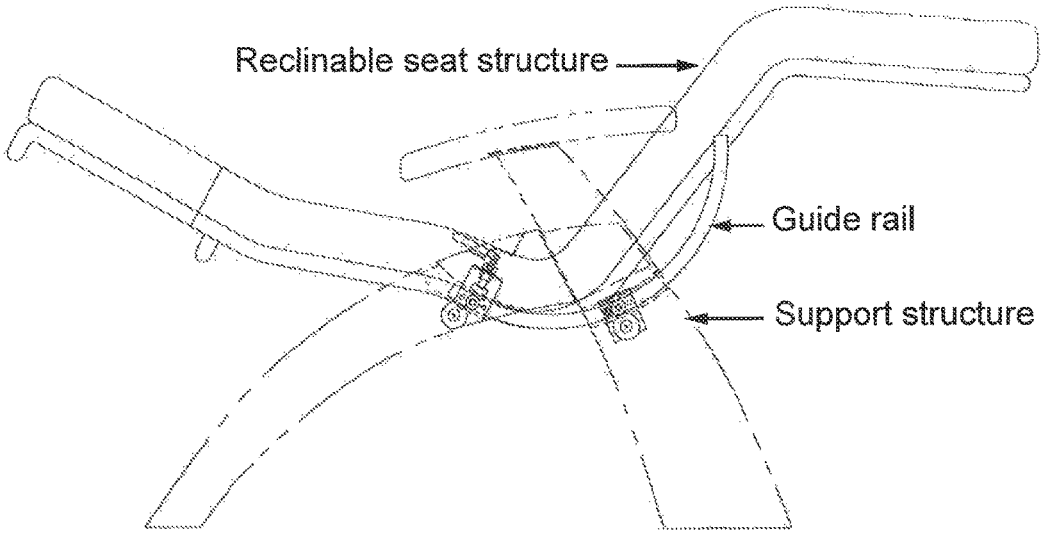
FIG. 3 shows the general configuration of a reclining chair disclosed in U.S. Pat. No. 6,012,774 ("Potter")
Figure 4:
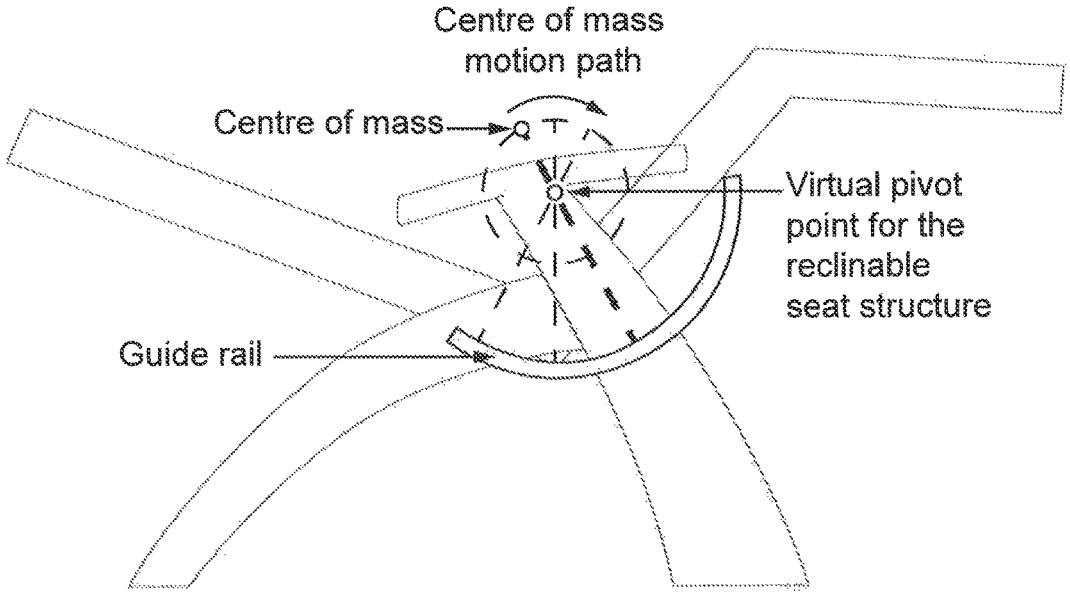
FIG. 4 is a schematic drawing of the reclining chair disclosed in U.S. Pat. No. 6,012,774 ("Potter"), showing the virtual pivot point for the reclinable seat structure, the combined centre of mass of the reclinable seat structure and occupant, and the motion path of the centre of mass.
Figure 5:
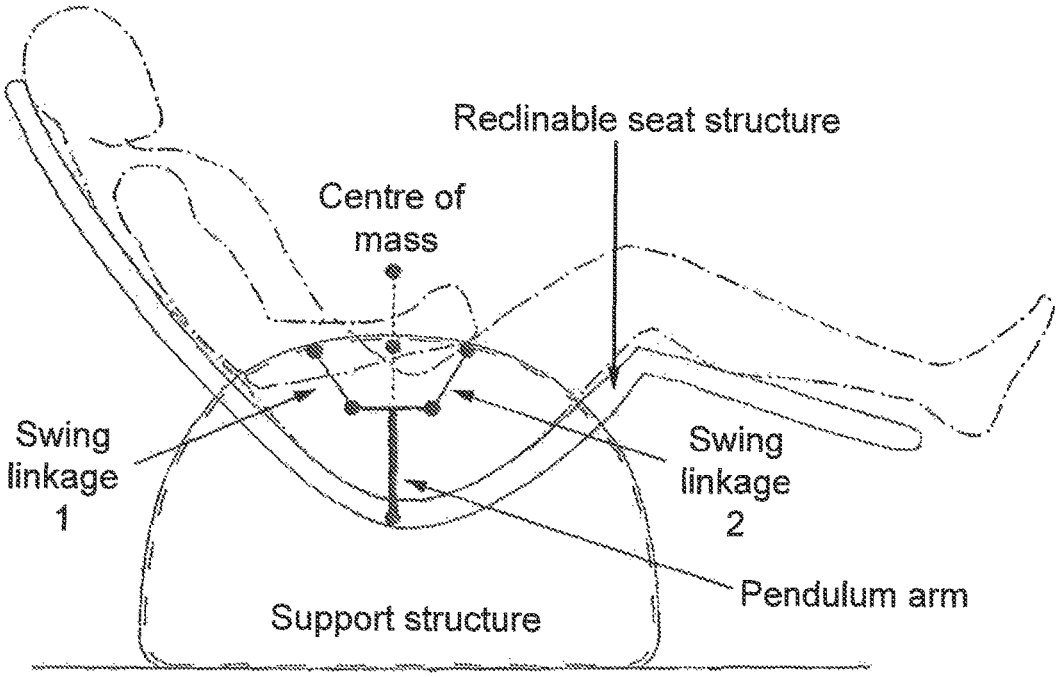
FIG. 5 shows a reclining chair disclosed in European Patent No. 0,918,480 B1 ("Samson"), showing the general configuration and the swing pivots of the seat recline mechanism.
Figure 6:
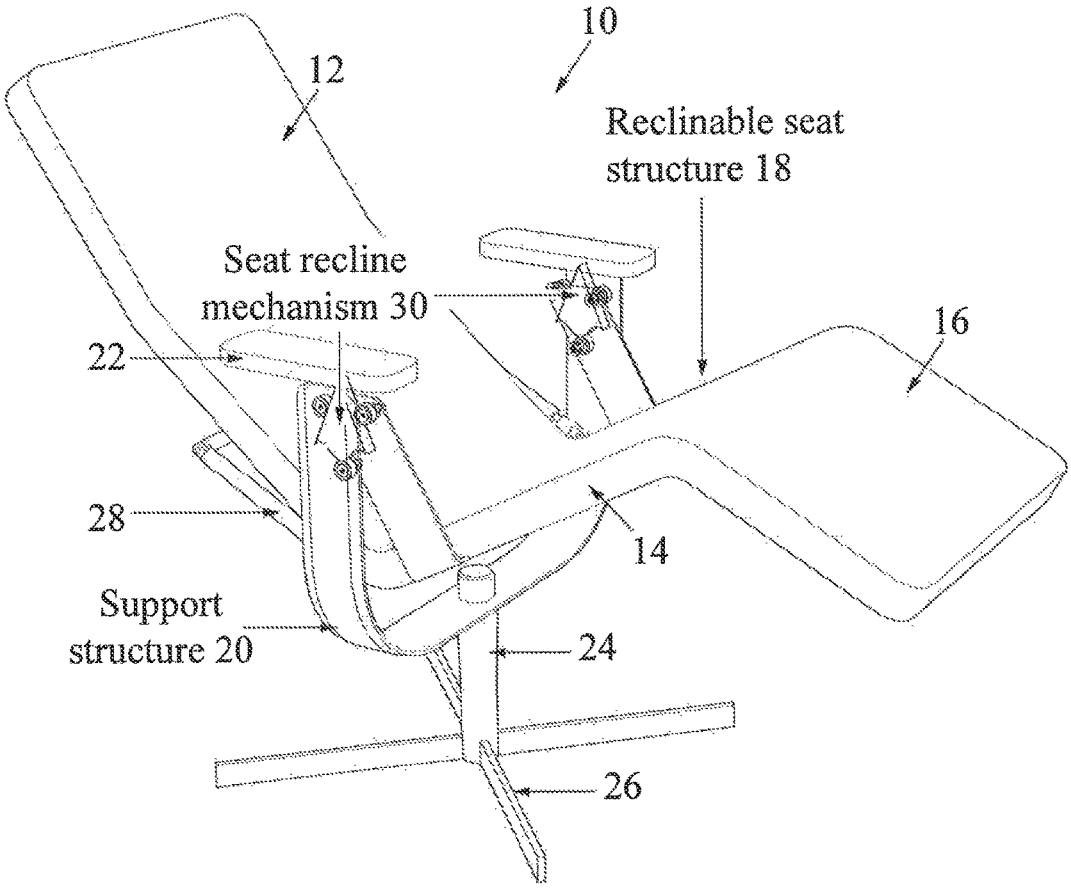
FIG. 6 is a perspective view of an example of a chair design having a seat recline mechanism according to an embodiment of the present invention.

FIG. 6 illustrates a reclining chair 10 embodying the present invention. The chair includes a back section 12, a seat section 14 and a leg rest section 16. Together, the back section 12, seat section 14 and leg rest section 16 form a reclinable seat structure 18. The reclinable seat structure 18 is movable within a support structure 20 (in this case, an outer base frame). A pair of seat recline mechanisms 30 according to an embodiment of the present invention are provided at the interface between the reclinable seat structure 18 and the support structure 20, generally below the armrest 22 at each side of the chair. That is to say, one seat recline mechanism 30 is provided on one side of the chair, and the other seat recline mechanism 30 is provided on the other side of the chair. It should be noted that, in FIG. 6, the sides of the chair are shown in a partly transparent manner, so that the reader's view of the seat recline mechanism 30 is not obscured by the support structure 20.

In this example the general construction of the chair 10 is modular such that the reclinable seat structure 18 can be produced in a variety of ways to achieve a range of products. Examples include an upholstered version, a CNC timber frame version, a pressed laminated plywood version and a cold moulded polycarbonate version, In the present example, the support structure 20 is produced from flat steel formed to create a 'U' shape, and sits on a memory return spindle 24 located on a star base 26 that gives a swivel function. The support structure 20 may be a standard component across a range of chair models. Similarly, the spindle 24 and star base 26 may also be standard components across a range of chair models. As those skilled in the art will appreciate, other shapes and configurations of spindles and pedestal bases are of course possible, as are the radii and general proportions of the support structure 20.

Figure 7:
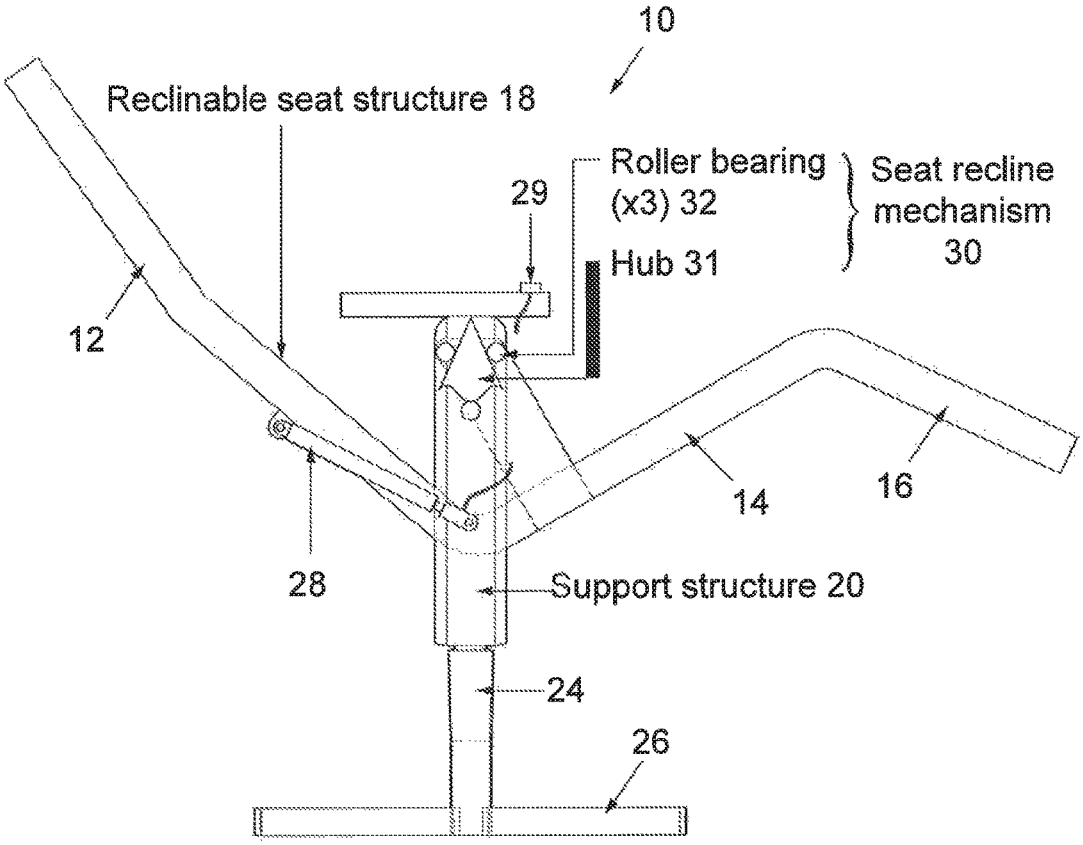
FIG. 7 is a side view of the chair design of FIG. 6 incorporating the seat recline mechanism according to an embodiment of the invention, and also showing a lockable gas spring and a button release.

As shown in FIG. 7, a commercially-available lockable gas spring 28 with a remote hydraulic button release 29 may be employed to releasably lock the chair (i.e. to releasably lock the angle of the reclinable seat structure relative to the base) and to dampen acceleration of the reclinable seat structure 18 as it moves. In certain embodiments it may also be preferable to have a second gas spring on the other side of the chair, lockable or otherwise. Although the two functions of locking and dampening are suggested in one component, the functions could be decoupled into two components, such as a dedicated damper on one side of the chair, and a gas spring on the other side of the chair, specified for locking only. In any respect, a lockable gas spring permits two modes of use: (1) an active recline mode where the button 29 must be manually held down to move the reclinable seat structure 18 and where quick release of the button 29 locks the chair rigid; and (2) a passive recline mode for continuous motion without pressing the button. The two modes of use can be achieved in a variety of ways. For example, the release button 29 may have a sprung mechanism that permits gas spring activation when pressing approximately half way down the stroke of the button, but springs back to lock when released. This would achieve the active mode of use. For the passive mode, pressing the button to its extent may click the button in position so that it does not spring back when released and lock the gas spring. Such a button mechanism may then require a second application of force to return the button to its extended position. Both hydraulic and wire type button release mechanisms are feasible with connecting parts that permit multiple buttons for controlling one or more gas springs. With such a mechanism, a standard button release could be used for the active recline mode, and a second button could be available in a more discrete location on the chair that clicks into a fixed position when pressed to its extent as described above. An additional benefit of using a gas spring 28 for locking the chair is that there is practically no restriction on where to place the button 29. (Indeed, Potter explained that the operating lever for the brake assembly in Goldman is awkward to use partly due to its location on the chair.)

The seat recline mechanism 30, and its operation, will now be described in more detail.

Seat Recline Mechanism

The aim of the design of the seat recline mechanism 30 is to achieve, in use (e.g. during reclining movement or uprighting movement), a motion path for the reclinable seat structure 18 that results in a substantially horizontal motion path for the centre of mass (COM) for any occupant. This aim is similar to that in Samson. By having a horizontal motion path for the COM during use, the chair feels well balanced to the user, and is straightforward to use with minimal effort on the part of the user, The COM includes the mass of the reclinable seat structure 18 as well as the user, and its motion has been simulated using a development of a biomechanical model published by the inventor (Wickett. D. H. 2013, Development, Validation and Application of a Biomechanical Model of Reclined Sitting Posture, Ph.D. Thesis, Anglia Ruskin University, Cambridge, UK). Applying the biomechanical model to a preferred embodiment of the present seat recline mechanism, the motion path for the COM of a 50th percentile female anthropometric model was found to remain perfectly horizontal during movement of the seat, with minimal variation from the horizontal for 5th and 95th percentile male models including additional thoracic loads.

With reference to FIGS. 6-9, each seat recline mechanism 30 comprises a central hub 31 and at least two bearing components 32 (in this example, roller bearings) which are able to translate around the perimeter of the hub 31. In the presently-preferred embodiments the roller bearings 32 have studs that allow them to be screwed into mating components at the external faces of the reclinable seat structure 18 (for example machined steel bosses with tapped holes for receiving the bearing studs). The hub 31 (which in the present examples is a machined steel component) is fixed to an inwardly-facing surface of the support structure 20.

Figure 8:
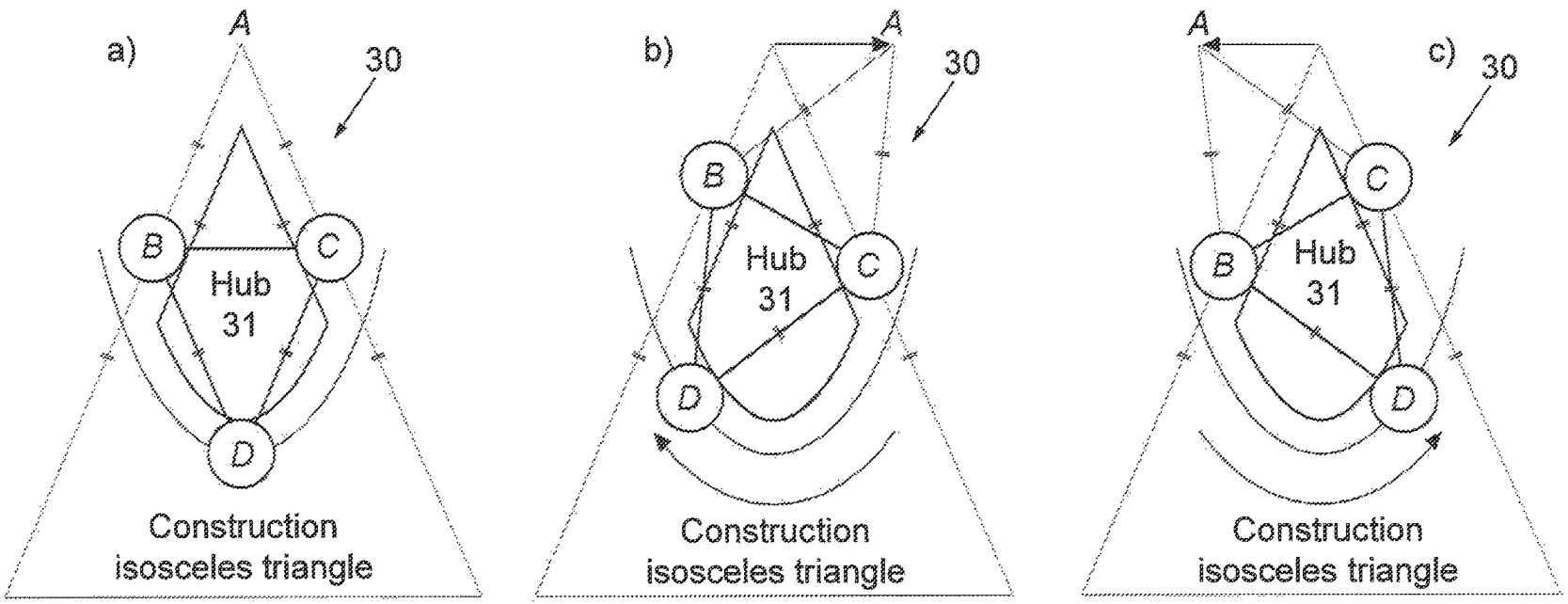
FIG. 8 shows the cross-sectional geometry of a seat recline mechanism according to an embodiment of the invention, in, from left to right, (a) a mid recline position; (b) a forward position; and (c) a maximum recline position, showing a horizontal motion path for the centre of mass.
Figure 9:
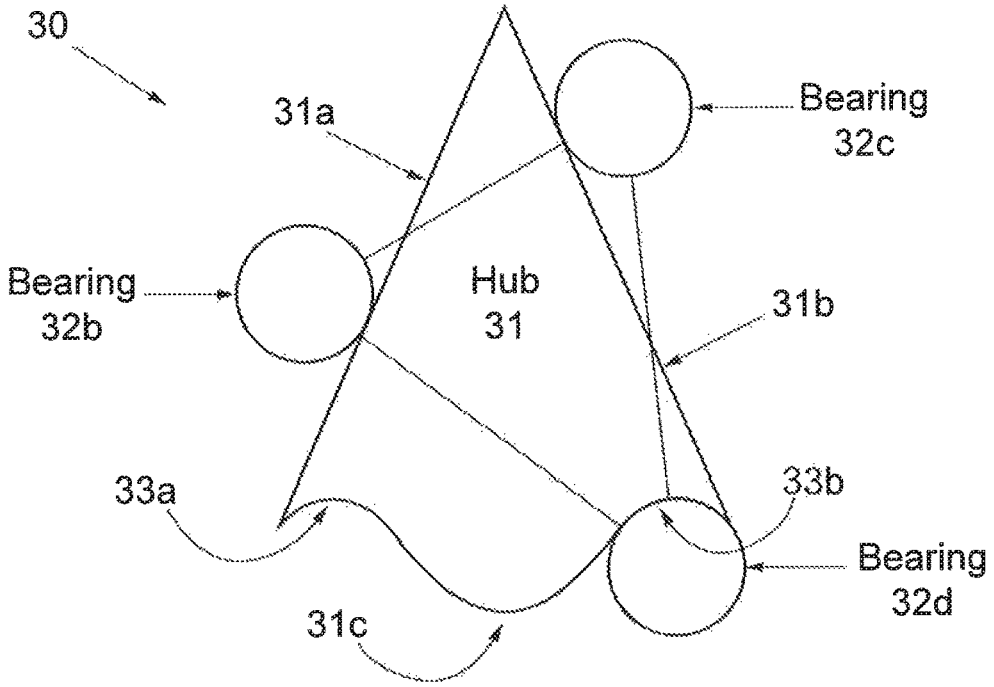
FIG. 9 illustrates a development of the geometry in FIG. 8, with the curve defined by the lowest bearing having been modified to limit the range of movement of the seat recline mechanism.

As will be appreciated from FIGS. 6-9, the cross-sectional shape of the perimeter of the hub 31 is non-circular. In the presently-preferred embodiments shown in FIGS. 6-9 the cross-sectional shape of the perimeter of the hub 31 has mirror symmetry about a vertical axis, although in other embodiments this need not necessarily be the case. With reference to FIG. 9 by way of example, the perimeter of the hub 31 has two oppositely-facing, upwardly-facing, inclined (e.g. diagonally-oriented) surfaces 31*a*, 31*b* on which the upper two load-bearing roller bearings 32*b*, 32*c* respectively act (one roller bearing acting on each of the inclined upper surfaces). In so doing, the upper two roller bearings 32*b*, 32*c* transmit the weight of the reclinable seat structure 18 (and the user) down to the base 20, via the hub 31.

As those skilled in the art will appreciate, the hub 31 effectively acts as a cam, with the roller bearings 32*b*, 32*c* acting on the inclined surfaces of the cam.

Figure 10:
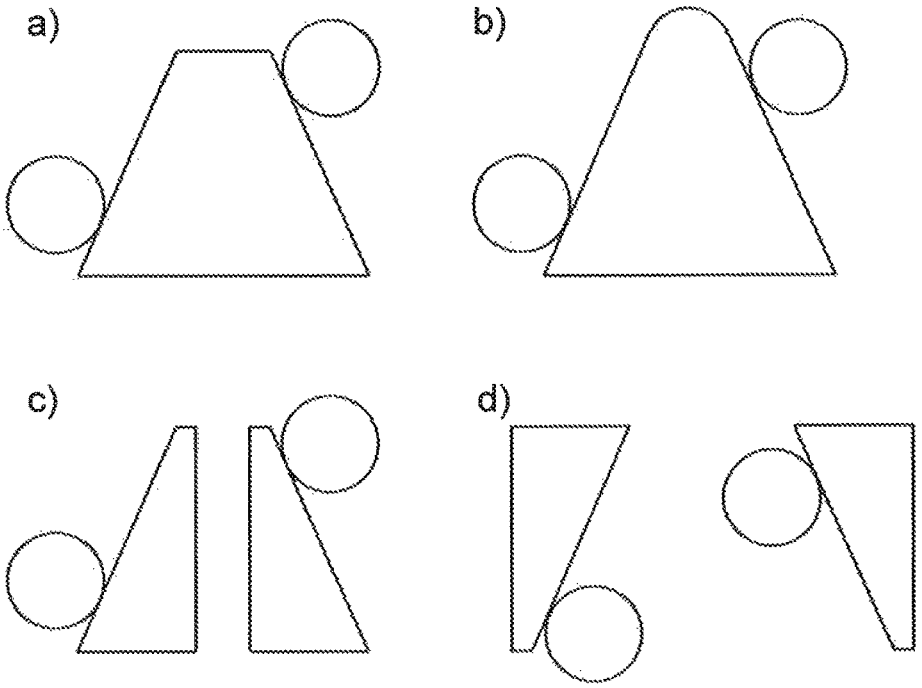
FIGS. 10(*a*)-(*d*) show some possible alternative cross-sectional geometries for the hub of the seat recline mechanism—in each case showing a pair of roller bearings (depicted by the two circles) and the hub geometry (depicted by the other shape(s))

In the present embodiments the inclined upper surfaces 31*a*, 31*b* of the perimeter of the hub 31 substantially form an inverted "V" shape, with the inclined upper surfaces 31*a*, 31*b* meeting at an apex or a rounded tip. However, in alternative embodiments one or more other surfaces may be interposed between the inclined upper surfaces 31*a*, 31*b*. Some examples of such alternative geometries are shown in FIGS. 10(*a*) and 10(*b*). In each of these illustrations the bearings are depicted by the circles and the hub is depicted by the other shape. FIG. 10(*a*) illustrates a flat surface interposed between the two inclined upper surfaces on which the bearings act, and FIG. 10(*b*) illustrates a curved surface interposed between the two inclined upper surfaces on which the bearings act.

In the present embodiments the hub 31 is formed as a unitary structure (e.g. machined from steel, or some other suitable material). However, in other embodiments the hub 31 may comprise a plurality of hub components (e.g. discrete, spatially-separated components), such that one or more of the bearing surfaces are provided by one hub component, and one or more others of the bearing surfaces are provided by one or more other hub components.

Figure 11:
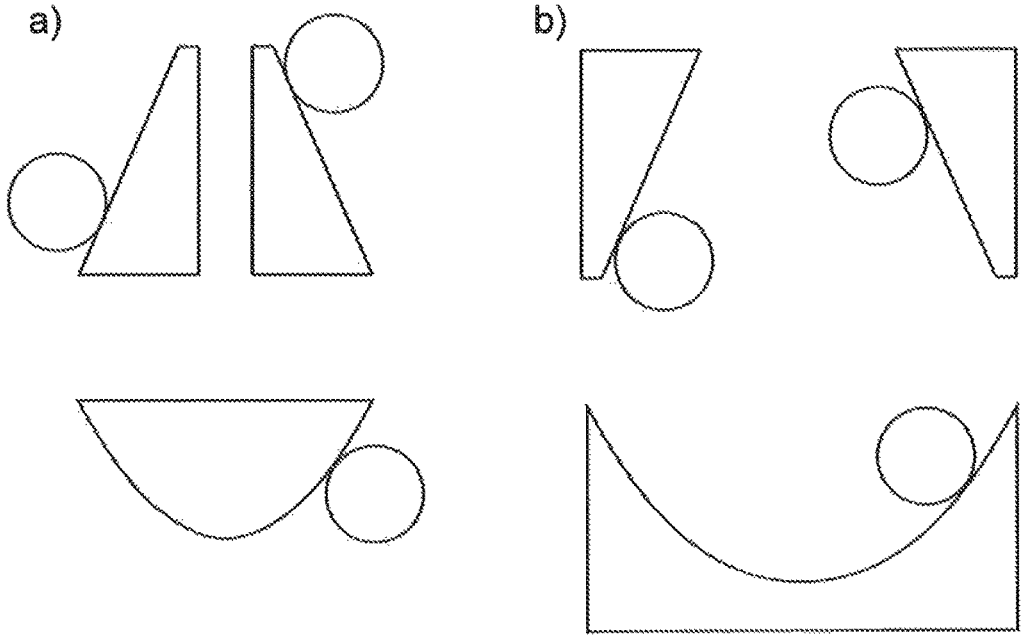
FIGS. 11(*a*)-(*b*) show further possible alternative cross-sectional geometries for the hub of the seat recline mechanism—in each case showing three roller bearings (depicted by the three circles) and the hub geometry (depicted by the other shapes).

Some examples of such arrangements are shown in FIGS. 10(*c*) and 10(*d*), and in FIGS. 11(*a*) and 11(*b*). FIG. 10(*c*) illustrates a hub comprising two spatially-separated hub components. Two bearings (depicted by the circles) act against the hub, with each bearing acting on the inclined upper surface of a respective hub component (depicted by the other shapes). FIG. 10(*d*) illustrates a different arrangement, with the hub again comprising two spatially-separated hub components, and two bearings (depicted by the circles) acting against the hub, but with each bearing acting against an inclined inner surface of a respective hub component (depicted by the other shapes).

In FIG. 11(*a*) the hub comprises three spatially-separated hub components. Three bearings (depicted by the circles) act against the hub, with each bearing acting against an outer surface of a respective hub component (depicted by the other shapes). FIG. 11(*b*) illustrates a different arrangement, with the hub again comprising three spatially-separated hub components, and three bearings (depicted by the circles) acting against the hub, but with each bearing acting against an inner surface of a respective hub component (depicted by the other shapes).

In the presently-preferred embodiments (e.g. as shown in FIGS. 6-9), each of the load-bearing roller bearings 32*b*, 32*c* is able to move, in use, along substantially the entire length of the respective inclined upper surface 31*a*, 31*b* of the perimeter of the hub 31. However, other embodiments may be conceived in which this is not the case.

In the presently-preferred embodiments, each of the inclined upper surfaces 31*a*, 31*b* of the perimeter of the hub 31 has a smooth monotonic geometry (e.g. a linear profile or, as an alternative, a smooth monotonic curve), to enable smooth translation of the roller bearings and thus smooth adjustment of the angle of the seat. However, in alternative embodiments the inclined upper surfaces 31*a*, 31*b* of the perimeter of the hub 31 may be provided with one or more detents or other irregularities, for example to regulate the translational movement of the bearings 32*b*, 32*c* in use. For example, such detents may define one or more positions at which the seat angle will be detained before, during or after reclining motion. When detained in such a position, a redistribution of the user's weight or the application of some other force (in practice, a relatively slight one) would be required to overcome the effect of the detent and thereby permit further adjustment of the angle of the seat.

Optionally, as shown for example in FIGS. 6-9, a third roller bearing 32*d* may be provided that acts against an undersurface 31*c* of the perimeter of the hub 31, to retain all the bearings 32*b*, 32*c*, 32*d* on the hub 31 (thereby preventing the reclinable seat structure 18 from being detachable from the support structure 20 during use) and/or to limit the range of adjustment of the angle of the seat. For assembly, the third (i.e. lowest) roller bearing 32*d* has adjustment to reduce the tolerance between the roller bearings 32 and the hub 31.

The undersurface 31*c* of the hub 31 on which the third roller bearing 32*d* acts may be profiled as shown in FIGS. 6, 7 and 9 to effectively incorporate a stop 33*a*, 33*b* at each end, so as to limit the overall range of adjustment of the angle of the seat.

FIG. 8 shows the geometry from which the present embodiments are derived. The geometry is based on an isosceles triangle with a horizontal base and upper vertex positioned at the predicted COM location in the side view. The vertices A,B,C,D and the reclinable seat structure have a fixed geometrical relationship, Vertices B,C,D represent the location for the roller bearings (32*b*, 32*c*, 32*d*) and vertex A represents the location of the COM. Vertices B and C are constrained to travel along the legs of the isosceles triangle which defines the motion path of the reclinable seat structure 18 and occupant. Vertex D is constrained to the locus defined by B and C. The purpose of the roller bearing (32*d*) at vertex D is to lock all roller bearings (32*b*, 32*c*, 32*d*) and the reclinable seat structure 18 to the hub 31; its distance from B and C is arbitrary.

FIG. 9 extends the geometry shown in FIG. 8 to limit the range of motion. Here, the curve at the base of the hub 31 which constrains vertex D is modified to stop the bearing 32*d* at the desired terminal positions of the chair.

Providing that the proportion of the triangle ABC is the same as the construction triangle as shown in FIG. 8, the predicted COM (vertex A) will translate perfectly horizontally. The shape of the construction isosceles triangle and the size of triangle ABC will be influenced by physical constraints of the chair such as the presence of an armrest, the size of the bearings, and aesthetic requirements. Increasing the angle at vertex A and the height of triangle ABC will increase the distance the COM travels, and this may affect the stability of the chair.

Thus, in the example shown in FIG. 8, vertices B and C are constrained to move along the legs of the construction isosceles triangle. Vertex A will always translate horizontally providing the proportion of the triangle ABC is the same as the construction triangle. The locus for vertex D is defined by vertices Band C. The distance between vertex D and vertices B and C is arbitrary. Vertices B, C and D define the position of the bearings (32*b*, 32*c*, 32*d*), and vertex A represents the combined centre of mass of the reclinable seat structure and occupant. The geometry of the hub 31 may be defined from the loci of the bearings.

The geometries shown in FIGS. 8 and 9 are examples where the objective has been for the predicted COM to translate horizontally. In other designs it may be desirable not to have a horizontal COM motion path. Since the hub is a free form it is possible to define almost any locus. For example, it may be desirable to ramp the COM motion path towards its midpoint, or the terminal position(s).

As shown in FIGS. 6, 7 and 8(*a*), preferably the upper two roller bearings (32*b*, 32*c*) are in a substantially horizontal relationship on the hub 31 when the chair is in a mid recline position. From this position, when the chair moves into an upright or forward position as shown in FIG. 8(*b*), the forward-most upper roller bearing (32*c*) moves down its respective inclined surface (31*b*) of the hub 31, and the rearmost upper roller bearing (32*b*) moves up its respective inclined surface (31*a*) of the hub 31. Conversely, starting from the mid recline position of FIG. 8(*a*), when the chair moves into a maximum recline position as shown in FIG. 8(*c*), the forward-most upper roller bearing (32*c*) moves up its respective inclined surface (31*b*) of the hub 31, and the rearmost upper roller bearing (32*b*) moves down its respective inclined surface (31*a*) of the hub 31. As shown, during both the reclining and uprighting operations the COM moves substantially horizontally, and consequently the chair feels well balanced to the user, and is straightforward to use with minimal effort on the part of the user.

Method of Use

With reference back to FIGS. 6 and 7, in use a user sits on the reclinable seat structure 18 of the chair 10, with their bottom on the seat section 14, their back against the back section 12, and their calves against the leg rest section 16. They may also rest their head against a head rest if one is included.

Simply by the user moving their COM rearwards (e.g. by pushing against the armrests, changing posture and/or changing muscle tone), and with any locking mechanism (e.g. the above-described lockable gas spring 28) disengaged, the reclinable seat structure 18 will recline backwards. Conversely, when the reclinable seat structure 18 is in a reclined position, simply shifting the COM forwards (e.g. pulling on the armrests, changing posture and/or changing muscle tone) will cause the reclinable seat structure 18 to return towards an upright position, again with any locking mechanism disengaged.

At any point, the user may releasably lock the angle of inclination of the reclinable seat structure 18 using the lockable gas spring 28 or other locking mechanism. Alternatively, for entirely free movement, the locking mechanism may be disengaged altogether, or not provided in the first place.

In the presently-preferred embodiment, by virtue of the horizontal COM motion path as described above, in use the chair and the user feel well balanced, and the reclining (or uprighting) operation is straightforward to effect with minimal effort on the part of the user.

Possible Modifications and Alternative Embodiments

Detailed embodiments have been described above, together with some possible modifications and alternatives. As those skilled in the art will appreciate, a number of additional modifications and alternatives can be made to the above embodiments whilst still benefiting from the inventions embodied therein.

For example, further modifications to the hub may be desirable, such as grooves or bumps in the bearing surfaces to hold the reclinable seat structure in predetermined positions (e.g. in the upright, mid recline and full recline postures) and/or to give haptic feedback for improved position sense (e.g. bumps that get closer together towards the terminal positions). Alternative locking systems could also be incorporated directly into the seat recline mechanism such as a spring pin with remote release to fix the bearing position.

In the example given the reclinable seat structure 18 has a back section 12, a seat section 14 and a leg rest section 16 with a fixed structural relationship. However, the present seat recline mechanism 30 could also be used if there were articulations in the reclinable seat structure 18, such as a retractable leg rest, an adjustable seat-to-backrest angle, and adjustment in the backrest (e.g. for head support). Such articulations could be manually adjusted in subassemblies or synchronised with the seat recline mechanism via linkages.

Indeed, various moving parts of the seat may be envisaged that are configured so as to move in dependence on the operation of the seat recline mechanism. The moving parts may include, for example, one or more of a retractable leg rest, a reclining backrest (reclinable with respect to the seat), a headrest/backrest articulation, or a foldaway armrest. In all such cases, mechanical linkages can be arranged such that these moving parts are adjusted as the seat recline mechanism operates.

The above embodiments have been described with roller bearings 32 serving as bearing means. However, the seat recline mechanism may alternatively employ other bearing components or bearing means that would translate around the perimeter of the hub. In this context, the term "bearing" as used herein should be interpreted broadly so as to encompass a toothed or cog-like component; in such a case, the perimeter surfaces of the hub (e.g. surfaces 31*a* and 31*b*) may incorporate a series of indentations, recesses or gaps for the teeth of the cog-like component to engage in. Conversely, the perimeter surfaces of the hub may incorporate teeth, and the bearing may incorporate indentations, recesses or gaps for said teeth to engage in.

The number of bearing components on each hub is not restricted to three; more than three bearings may be used on each hub, or fewer than three. There may also be multiple hubs. In various alternative embodiments the bearing components could either travel along the outside of the hub perimeter, the inside of the hub perimeter, or both.

The seat recline mechanism could also be conceptually inverted, such that the bearings are fixed and the hub is movable within them. For example, the bearings may be fixed to the support structure 20, whilst the hub (which is movable relative to the bearings) may be attached to the reclinable seat structure 18.

The present embodiments have been described as a seat recline mechanism for controlling the movement of the reclinable seat structure 18. However, other embodiments could be used to control the motion path of other subassemblies, such as a seat backrest articulation.

Finally, based on the principles of the above-described embodiments, mechanisms for controlling the motion of articulated assemblies in fields of industry other than seating may be provided. Thus, in a general sense, a mechanism may be provided for controlling the motion of a first assembly relative to a second assembly, the mechanism comprising: first and second bearing means for attaching to the first assembly; and a hub for attaching to the second assembly; wherein the hub includes first and second inclined surfaces, the second inclined surface being oppositely-facing relative to the first inclined surface; and wherein, in use, the first bearing means is arranged to act against the first inclined surface and the relative position of the first bearing means with respect to the first inclined surface is adjustable, and the second bearing means is arranged to act against the second inclined surface and the relative position of the second bearing means with respect to the second inclined surface is adjustable. This mechanism may be modified to include any of the features described above. An articulated assembly comprising one or more such mechanisms may also be provided.

The invention claimed is:

1. A seat recline mechanism for controlling the motion of a first assembly relative to a second assembly within a seating assembly, the seat recline mechanism comprising;

first and second bearings for attaching to the first assembly; and a hub for attaching to the second assembly;

wherein the hub includes first and second inclined surfaces, the second inclined surface being oppositely-facing relative to the first inclined surface;

wherein, in use, the first bearing is arranged to act against the first inclined surface, and the second bearing is arranged to act against the second inclined surface; and wherein the relative position of the first bearing with respect to the first inclined surface, and the relative position of the second bearing with respect to the second inclined surface, are both movable to produce a non-fixed axis of rotation of the first assembly relative to the second assembly.

2. The seat recline mechanism according to claim 1, further comprising a third hearing for attaching to the first assembly;

wherein the hub includes a third surface; and wherein, in use, the third bearing is arranged to act against the third surface and the relative position of the third bearing with respect to the third surface is movable.

3. The seat recline mechanism according to claim 2, wherein the third surface of the hub is substantially at the bottom of the hub.

4. The seat recline mechanism according to claim 2, wherein the third surface of the hub incorporates a stop for limiting the extent of relative movement of the third bearing with respect to the third surface.

5. The seat recline mechanism according to claim 4, wherein the third surface of the hub is shaped so as to incorporate the stop.

6. The seat recline mechanism according to claim 1, wherein the first and second surfaces of the hub are substantially linear.

7. The seat recline mechanism according to claim 1, wherein at least one of the first surface and the second surface of the hub incorporates surface detailing.

8. The seat recline mechanism according to claim 1, wherein the said surfaces are formed around the perimeter of the hub.

9. The seat recline mechanism according to claim 1, wherein the said surfaces are formed inside the perimeter of the hub.

10. The seat recline mechanism according to claim 1, wherein the hub is formed as a unitary structure.

11. The seat recline mechanism according to claim 1, wherein the hub comprises a plurality of hub components, such that the first surface of the hub is provided by one hub component, and the second surface of the hub is provided by another hub component.

12. A seating assembly comprising:

a first assembly;

a second assembly; and at least one seat recline mechanism for controlling the motion of the first assembly relative to the second assembly, said seat recline mechanism comprising:

first and second bearings attached to the first assembly; and a hub attached to the second assembly;

wherein the hub includes first and second inclined surfaces, the second inclined surface being oppositely-facing relative to the first inclined surface;

wherein the first bearing is arranged to act against the first inclined surface, and the second bearing is arranged to act against the second inclined surface; and wherein the relative position of the first bearing with respect to the first inclined surface, and the relative position of the second bearing with respect to the second inclined surface, are both movable to produce a non-fixed axis of rotation of the first assembly relative to the second assembly.

13. The seating assembly according to claim 12, wherein, in respect of said seat recline mechanism:

the first assembly is a reclinable seat structure;

the second assembly is a support structure for the reclinable seat structure; and the reclinable seat structure is able to move relative to the support structure in a reclining manner by movement of said hearings along said surfaces.

14. The seating assembly according to claim 13, further comprising a securer for reversibly securing the angle of the reclinable seat structure relative to the support structure; and wherein said securer is one of a direct locking device and a remote locking device, and wherein the locking device is one of a spring pin and a gas spring with a remotely-actuated release.

15. The seating assembly according to claim 12, wherein, in respect of said seat recline mechanism:

the second assembly is a reclinable seat structure;

the first assembly is a support structure for the reclinable seat structure; and the reclinable seat structure is able to move relative to the support structure in a reclining manner by rotation of the hub relative to the positions of said bearings.

16. The seating assembly according to claim 15, further comprising a securer for reversibly securing the angle of the reclinable seat structure relative to the support structure; and wherein said securer is one of a direct locking device and a remote locking device, and wherein the locking device is one of a spring pin and a gas spring with a remotely-actuated release.

17. The seating assembly according to claim 12, further comprising at least one movable part configured to move in dependence on the operation of the seat recline mechanism, the movable part being selected from a group consisting of a retractable leg rest, a reclining backrest, a headrest/backrest articulation, and a foldaway armrest.

18. A method of controlling the motion of a first assembly relative to a second assembly within a seating assembly, the method comprising:

attaching first and second bearings to the first assembly;

attaching a hub to the second assembly, wherein the hub includes first and second inclined surfaces, the second inclined surface being oppositely-facing relative to the first inclined surface;

arranging the first bearing to act against the first inclined surface of the hub;

arranging the second bearing to act against the second inclined surface of the hub;

allowing both the relative position of the first bearing with respect to the first inclined surface of the hub, and the relative position of the second bearing with respect to the second inclined surface of the hub, to be moved, thereby producing a non-fixed axis of rotation of the first assembly relative to the second assembly.

19. The method according to claim 18, wherein the hub further includes a third surface, and the method further comprises:

attaching a third bearing to the first assembly;

arranging the third bearing to act against the third surface of the huh; and allowing the relative position of the third bearing with respect to the third surface of the hub to change.

20. The method according to claim 19, further comprising limiting the extent of relative movement of the third bearing with respect to the third surface.

21. The method according to claim 18, further comprising incorporating surface detailing in at least one of the first surface and the second surface of the hub, so as to provide at least one of: enabling the first assembly to be held in at least one predetermined position relative to the second assembly, and giving haptic feedback to the user.

22. The method according to claim 18, wherein the first assembly is a reclinable seat structure, the second assembly is a support structure for the reclinable seat structure, and the method further comprises:

moving the reclinable seat structure relative to the support structure in a reclining manner by movement of said bearings along said surfaces.

23. The method according to claim 22, further comprising reversibly securing the angle of the reclinable seat structure relative to the support structure.

24. The method according to claim 18, wherein the second assembly is a reclinable seat structure, the first assembly is a support structure for the reclinable seat structure, and the method further comprises:

moving the reclinable seat structure relative to the support structure in a reclining manner by rotation of the huh relative to the positions of said bearings.

25. The method according to claim 24, further comprising reversibly securing the angle of the reclinable seat structure relative to the support structure.

* * * * *